US008206046B2

(12) United States Patent
Koyabu

(10) Patent No.: US 8,206,046 B2
(45) Date of Patent: Jun. 26, 2012

(54) RECORDING DEVICE WITH A SECOND PLATEN ROLLER THAT ROTATES AT A FASTER SPEED THAN A FIRST PLATEN ROLLER

(75) Inventor: Akira Koyabu, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 973 days.

(21) Appl. No.: 12/190,921

(22) Filed: Aug. 13, 2008

(65) Prior Publication Data

US 2009/0047052 A1 Feb. 19, 2009

(30) Foreign Application Priority Data

Aug. 15, 2007 (JP) ..... 2007-211648

(51) Int. Cl.
*B41J 3/60* (2006.01)
*B41J 3/54* (2006.01)
*B41J 15/16* (2006.01)

(52) U.S. Cl. ..... 400/149; 400/188; 400/618

(58) Field of Classification Search ..... 400/188, 400/149, 618
See application file for complete search history.

(56) References Cited

U.S. PATENT DOCUMENTS 5,211,492 A 5/1993 Hirano
5,505,550 A * 4/1996 Kitahara et al. ..... 400/618
6,641,314 B2 * 11/2003 Mogi ..... 400/120.01
6,784,906 B2 8/2004 Long et al.
6,921,222 B2 * 7/2005 Ng et al. ..... 400/618
2006/0056900 A1 3/2006 Itakura
2008/0003039 A1 * 1/2008 Sekino et al. ..... 400/188
2008/0003041 A1 * 1/2008 Sekino et al. ..... 400/188
2008/0252000 A1 * 10/2008 Dochi ..... 271/264

FOREIGN PATENT DOCUMENTS

EP 0 947 340 A2 10/1999
JP 2558723 B 2/1989
JP 4-17952 U 2/1992
JP 05096801 A * 4/1993
JP 05-131704 5/1993

(Continued)

OTHER PUBLICATIONS

NCR Corporation; "Introducing . . . New Simultaneous Two-sided Thermal Printing Technology"; NCR Corp advertisement; Feb. 2006.

*Primary Examiner* — Daniel J Colilla
(74) *Attorney, Agent, or Firm* — Kilpatrick Townsend & Stockton LLP

(57) ABSTRACT

A recording device that records images on both sides of a recording medium using two recording heads suppresses slack in the recording medium and conveys the recording medium reliably. A first recording unit 21 holds and conveys the roll paper 20 between a first recording head 22 that records images to one side of the roll paper 20 and a first platen roller 27. A second recording unit 41 located downstream from the first recording unit 21 holds and conveys the roll paper 20 between a second recording head 42 that records images to the other side of the roll paper 20 and a second platen roller 47. The first platen roller drive unit turns so that the circumferential speed of the second platen roller 47 is faster than the circumferential speed of the first platen roller 27.

13 Claims, 6 Drawing Sheets

FOREIGN PATENT DOCUMENTS

| | | | |
|---|---|---|---|
| JP | 06-064256 | | 3/1994 |
| JP | 06-156795 | | 6/1994 |
| JP | 06-262785 | | 9/1994 |
| JP | 07-195769 | | 8/1995 |
| JP | 08-151149 | A | 6/1996 |
| JP | 11-286147 | | 10/1999 |
| JP | 2000015886 | A * | 1/2000 |
| JP | 2000034043 | A * | 2/2000 |
| JP | 2004-009545 | A | 1/2004 |
| JP | 2006-082903 | A | 3/2006 |

* cited by examiner

RECORDING DEVICE WITH A SECOND PLATEN ROLLER THAT ROTATES AT A FASTER SPEED THAN A FIRST PLATEN ROLLER

CROSS-REFERENCES TO RELATED APPLICATIONS

This application claims priority to Japanese Patent Application No. 2007-211648, filed Aug. 15, 2007, the disclosure of which is incorporated by reference herein, in its entirety and for all purposes.

BACKGROUND OF THE INVENTION

1. Field of Invention

The present invention relates to a recording device in which a recording medium is conveyed by a platen roller.

2. Description of Related Art

Recording devices such as printers that record images on recording media and can record images on both sides of the recording media using a plurality of recording heads are known from the literature. See, for example, U.S. Pat. No. 6,784,906.

The printer taught in U.S. Pat. No. 6,784,906 conveys the image element that is used as the recording medium through a substantially straight transportation path, and uses two recording heads disposed along the transportation path to record images on one side of the image element using one recording head and record images on the other side of the image element using the other recording head. As described in U.S. Pat. No. 6,784,906, images can be recorded by the two recording heads on both sides of roll paper or other continuous sheet media used as the recording medium.

It is essential in a recording device that has a plurality of recording heads to reliably convey the recording medium with no slack or sagging between the recording heads. For example, if there is deviation in the parts used in the plural transportation rollers that convey the recording paper such that the rollers convey the paper at different speeds and slack results in the recording medium between the two recording heads, problems such as an offset in the recording positions on front and back sides, and the recording medium becoming skewed, wandering, or jamming, can occur.

SUMMARY OF THE INVENTION

A recording device according to the at least one embodiment of invention that records images on a recording medium using two recording heads suppresses development of slack in the recording medium and can thereby reliably convey the recording medium.

A recording device according to a first aspect of at least one embodiment of the invention has a first recording unit that has a first recording head for recording images on one side of a recording medium, and a first platen roller disposed opposite the first recording head, and conveys the recording medium by rotation of the first platen roller; and a second recording unit that is located on the downstream side in the recording medium transportation direction from the first recording unit, has a second recording head for recording images on the other side of the recording medium, and a second platen roller disposed opposite the first recording head, and conveys the recording medium by rotation of the second platen roller. The second platen roller rotates at a transportation speed that is faster than the transportation speed of the first platen roller.

Because the transportation speed of the second platen roller located on the downstream side in the recording medium transportation direction is faster than the transportation speed of the first platen roller located on the upstream side of the second platen roller, slack in the recording medium can be suppressed and tension can be applied between the first recording unit and the second recording unit. Shifting in the relative recording positions on opposite sides of the recording medium and trouble when conveying the recording medium can therefore be prevented.

Preferably, the recording device also has a roller drive unit for driving the first platen roller and second platen roller, and the roller drive unit drives the first platen roller and second platen roller by a single motor.

This enables reducing the size of the recording device.

Further preferably, the recording medium is wound at a predetermined winding angle to at least one of the first platen roller and second platen roller.

By winding the recording medium at a predetermined winding angle to the platen roller, the recording medium can be conveyed with greater force.

The roller drive unit can be rendered with a motor, a drive gear train for transferring drive power from the motor to the first platen roller, and a drive gear train for transferring drive power from the motor to the second platen roller.

By transferring drive power from a single motor through separate drive gear trains to the first platen roller and second platen roller, a single motor can be used to drive both the first platen roller and second platen roller. In addition, by appropriately adjusting the gear ratios in the respective drive gear trains, the speed ratio of the first platen roller and second platen roller can be easily and desirably set based on the speed of a single motor.

Further preferably, a plane including the nipping surface of the first recording head and the first platen roller in the first recording unit, and a plane including the nipping surface of the second recording head and the second platen roller in the second recording unit, are not the same plane and are instead positioned to form a predetermined angle therebetween.

By disposing the plane including the nipping surface of the first recording unit and the plane including the nipping surface of the second recording unit at a predetermined angle where the planes are not parallel, the recording medium discharged from the first recording unit winds at a predetermined winding angle to the second platen roller so that the direction in which the recording medium is conveyed changes, and a sufficient contact area is assured between the second platen roller and the recording medium. This inhibits slipping between the second platen roller and the recording medium, and thereby reduces slack in the recording medium and prevents the recording medium from jamming. By preventing slipping between the recording medium and the second platen roller on the downstream side in the recording medium transportation direction, slack can be suppressed between the first recording unit and the second recording unit, and shifting in the relative recording positions on opposite sides of the recording medium can be effectively prevented.

In addition, by rendering the plane including the nipping surface of the first recording unit and the plane including the nipping surface of the second recording unit so that they form a predetermined angle and are not parallel, slipping between the recording medium and the second platen roller can be prevented with a minimal distance from the nipping part of the first recording unit to the nipping part of the second recording unit. As a result, the length of recording media that is left between the nipping part of the first recording unit and the nipping part of the second recording unit after printing is completed can be minimized. The amount of recording medium that cannot be printed from the leading end of the recording medium and therefore cannot be used effectively when printing can therefore be reduced, and the recording medium can be used more effectively with less waste.

Further preferably, the recording medium is pulled out from a roll passed the first recording unit to the second recording unit; the first recording unit records an image on the surface that is on the inside when the recording medium is in the roll; and the second recording unit records an image on the surface that is on the outside when the recording medium is in the roll.

In this aspect of at least one embodiment of the invention the first recording unit records images on the surface of the recording medium that is on the inside when the recording medium is in the roll, and the second recording unit records images on the surface that is on the outside when the recording medium is in the roll. Because the wound roll paper is threaded through the first platen roller and second platen roller and conveyed while curving in alternating directions, the desired winding angle can be sufficiently assured at each platen roller. By thus recording on the side corresponding to the inside of the recording medium by the first recording unit and on the side corresponding to the outside of the recording medium by the second recording unit, a sufficient winding angle can be assured in the recording medium at the first platen roller and the second platen roller.

Yet further preferably, the recording medium winds around the second platen roller at a winding angle of 90 degrees or more.

By winding the recording medium to an angle of 90 degrees or more, sufficient contact area between the second platen roller and recording medium can be assured, slipping of the recording medium can be reliably prevented, and slack can be significantly reduced.

Yet further preferably, the recording device also has a storage unit for storing the recording medium wound in a roll; and a tension buffering mechanism that adjusts the tension of the recording medium on the transportation path from the storage unit to the first recording unit.

In this aspect of at least one embodiment of the invention the tension buffering mechanism buffers the application of momentarily high tension that is applied by the inertia of the wound roll paper when transportation starts and the roll paper is pulled out from the storage unit. In addition, tension can also be applied to the recording medium when slack results from the excess recording medium that is pulled off the roll of recording medium when conveying the recording medium stops, and slack in the transportation path to the first recording unit can be reduced.

A recording device according to another aspect of at least one embodiment of the invention has a main frame including the storage unit for storing the recording medium; and a cover frame attached to the main frame to open and close; wherein the first platen roller and second recording head are disposed to the main frame; the first recording head and second platen roller are disposed to the cover frame; and the nipping parts are formed between the first recording head and first platen roller, and between the second recording head and second platen roller, when the cover frame is closed.

After opening the cover frame and inserting the recording medium in this aspect of at least one embodiment of the invention, the recording medium is held in the first recording unit and second recording unit when the cover frame is closed. Loading the recording medium is therefore simple.

Another aspect of at least one embodiment of the invention is a recording device including a first recording unit that has a first recording head for recording images on one side of a recording medium, and a first platen roller disposed opposite the first recording head, and conveys the recording medium by rotation of the first platen roller; a second recording unit that is located on the downstream side in the recording medium transportation direction from the first recording unit, has a second recording head for recording images on the other side of the recording medium, and a second platen roller disposed opposite the first recording head, and conveys the recording medium by rotation of the second platen roller; and a roller drive unit for driving the first platen roller and second platen roller. The roller drive unit has a drive gear train for transferring drive power to the second platen roller; and the drive gear train includes a drive gear with a torque limiter that produces slipping when a predetermined load is applied.

The drive gear with a torque limiter thus constantly transfers a predetermined amount of torque to the second platen roller. When a load exceeding this torque level is applied, the predetermined torque is still transferred while the drive gear with torque limiter slips. As a result, even if an excessive load is applied to the recording medium from the second platen roller that conveys the recording medium at a faster speed, constant tension is applied to the recording medium because the same amount of torque is constantly applied, and slack in the recording medium can be greatly reduced.

At least one embodiment of the invention thus reduces slack in the recording medium that can result when the recording medium is conveyed to a first recording unit that records images on one side of the recording medium and to a second recording unit that records images to the other side of the recording medium, effectively prevents shifting in the relative recording positions on opposite sides of the recording medium, and prevents problems during paper transportation.

Other objects and attainments together with a fuller understanding of at least one embodiment of the invention will become apparent and appreciated by referring to the following description and claims taken in conjunction with the accompanying drawings.

DESCRIPTION OF PREFERRED EMBODIMENTS

A preferred embodiment of at least one embodiment of the invention is described below with reference to the accompanying figures.

Figure 1:
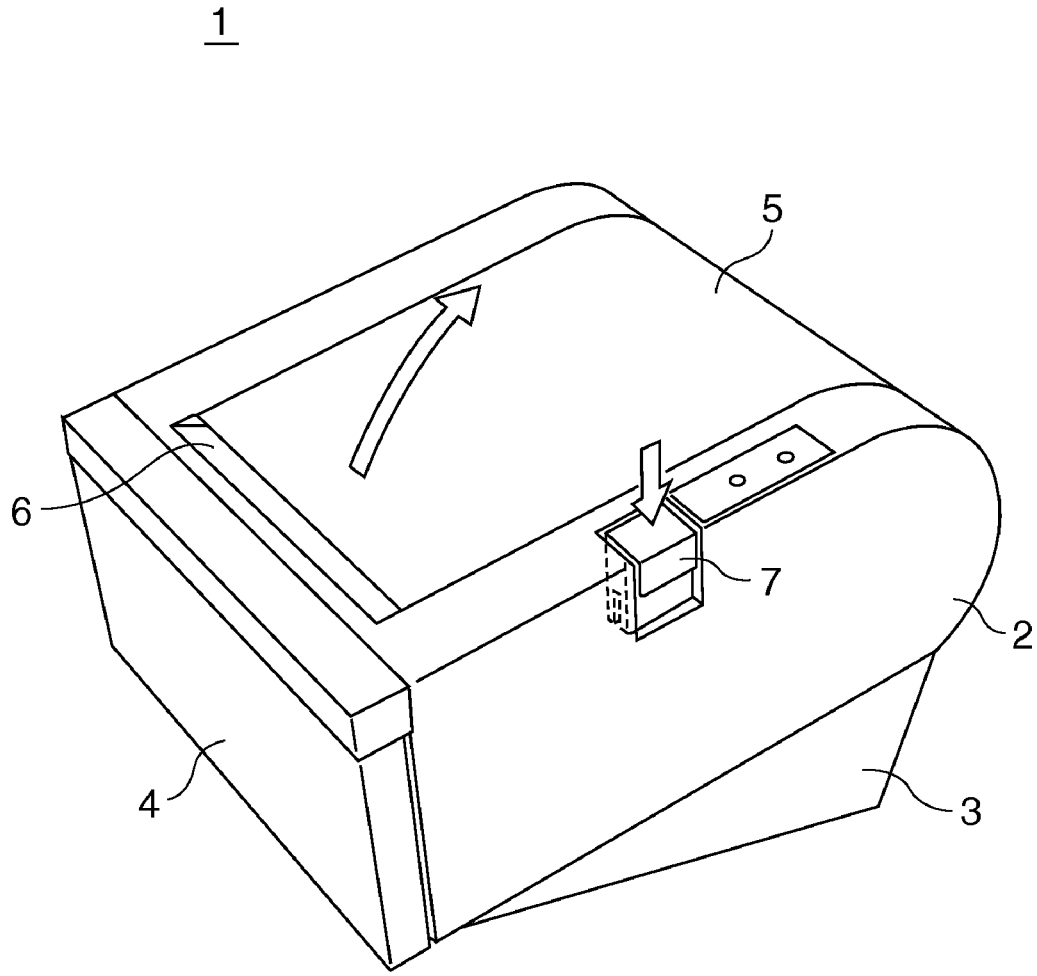
FIG. 1 is an oblique view showing the general appearance of a thermal printer according to a preferred embodiment of at least one embodiment of the invention.

FIG. 1 is an oblique view showing the general appearance of a thermal printer according to a preferred embodiment of at least one embodiment of the invention.

A thermal printer 1 described as a preferred embodiment of a recording device according to at least one embodiment of the invention is a printer that uses roll paper 20 (see FIG. 4), which is thermal paper wound in a roll, as the recording medium, and records images including text on the roll paper 20 by the recording heads that have thermal elements. The thermal printer 1 in this embodiment of at least one embodiment of the invention has two recording heads, and records images on both sides of the roll paper 20 by these two recording heads.

The recording medium used in this thermal printer 1 can be paper or a thin polymer sheet that is heat sensitive and changes color when exposed to heat, and is preferably wound on a core into a roll. The thermal printer 1 according to this embodiment of at least one embodiment of the invention uses roll paper 20.

In this embodiment of at least one embodiment of the invention the roll paper 20 is imparted with a chemical that turns black when heated by a coating, immersion, or adhesive process.

As shown in FIG. 1, the thermal printer 1 has a top case 2 and a bottom case 3 covering the outside, and a front cover 4 covering the front of the thermal printer 1. Part of the top of the top case 2 is a top cover 5 that can pivot open in the direction of the arrow in FIG. 1, and is normally closed when the thermal printer 1 is used. An opening button 7 for releasing a lock mechanism that holds the top cover 5 closed to open the top cover 5 is disposed at a top side part of the top case 2.

A paper exit 6 extending widthwise to the top case 2 is also disposed to the top case 2. The paper exit 6 is a hole that communicates with the space where the roll paper 20 is held below the top cover 5. The roll paper 20 on which images are recorded on both sides by the recording heads is discharged from the paper exit 6.

Figure 2:
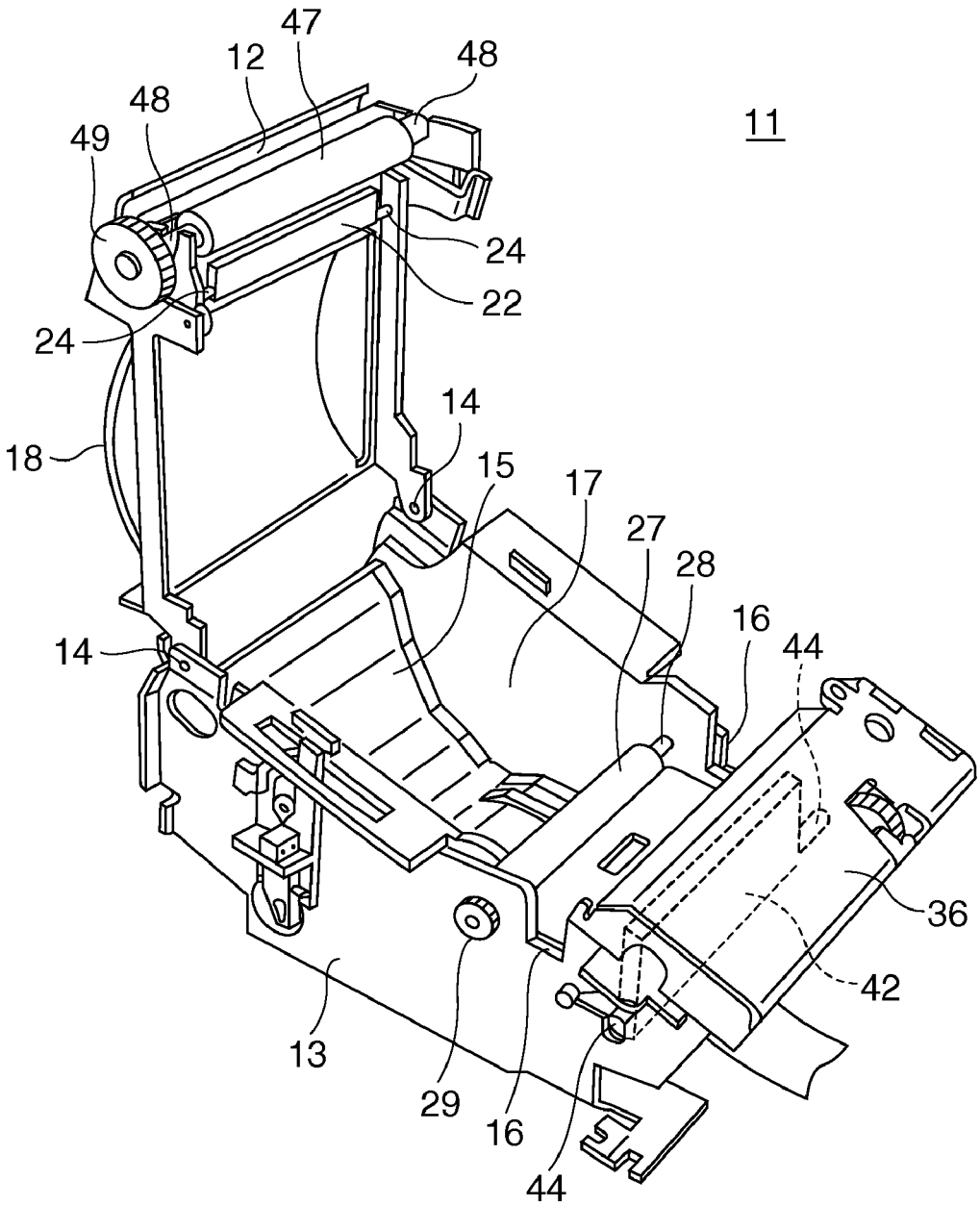
FIG. 2 is an oblique view showing the internal construction of the thermal printer.
Figure 3:
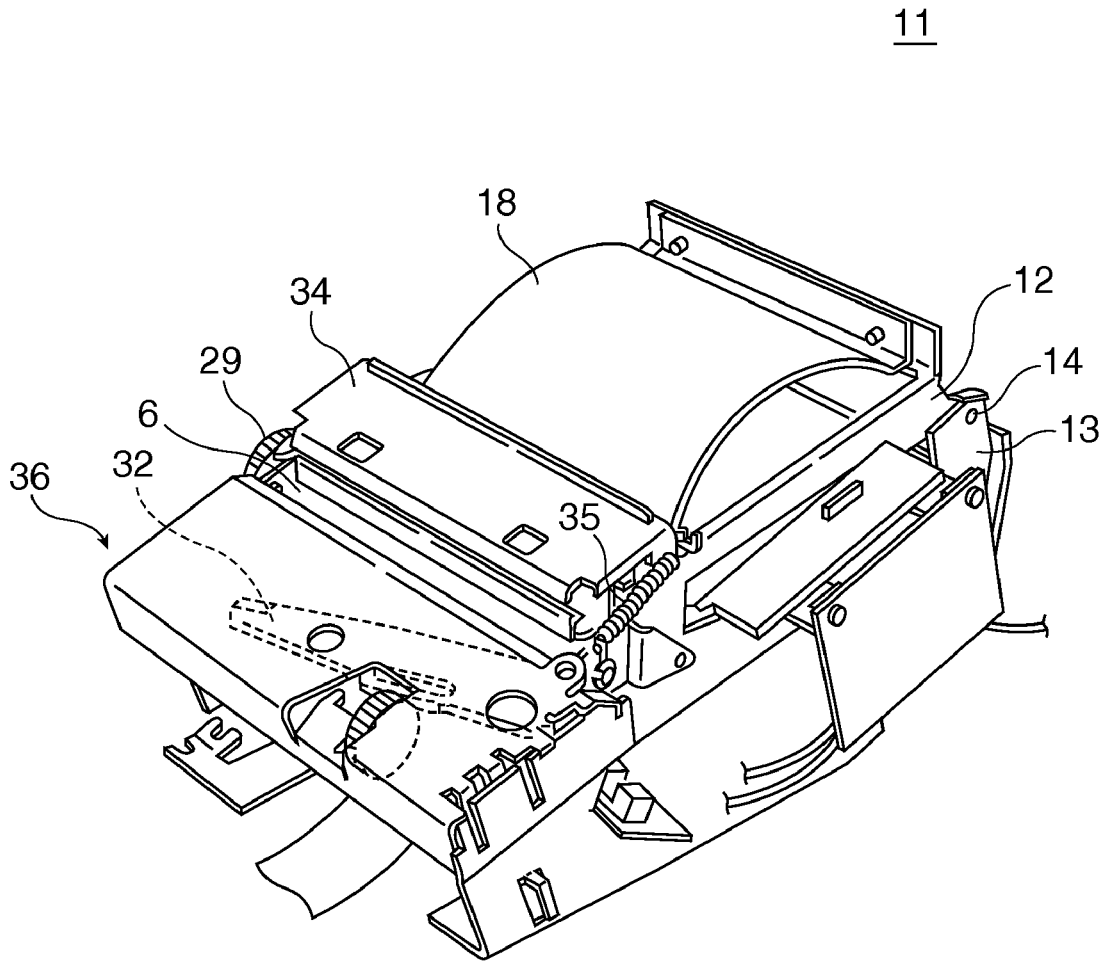
FIG. 3 is an oblique view showing the internal construction of the thermal printer.

FIG. 2 and FIG. 3 are oblique views showing the printer assembly 11 of the thermal printer 1. FIG. 2 shows the printer assembly 11 with the cover frame 12 open, and FIG. 3 shows the printer assembly 11 with the cover frame 12 closed.

The parts of the printer assembly 11 are disposed in the cover frame 12 and main frame 13, and during use is normally covered by the case members shown in FIG. 1.

The cover frame 12 is disposed inside the top cover 5 shown in FIG. 1, and opens and closes with the top cover 5 to the main frame 13.

The base end of the cover frame 12 is pivotably attached to the back end part of the main frame 13 by support pins 14. When the opening button 7 described above (see FIG. 1) is depressed in the direction of the arrow in FIG. 1, the cover frame 12 pivots on the support pins 14 from the closed position shown in FIG. 3 to the open position shown in FIG. 2. A first recording head 22 and a second platen roller 47 are disposed to the distal end part of the cover frame 12. The first recording head 22 records on the back side of the roll paper 20. The second recording head 42 described below applies pressure to the second platen roller 47 with the roll paper 20 therebetween.

The middle part of the cover frame 12 is open, and a roll paper cover 18 that is formed with a curve conforming to the shape of the roll paper 20 is attached to cover this opening in the cover frame 12.

A roll paper compartment 17 (storage unit) for storing the roll paper 20 is formed inside the main frame 13. A roll paper holder 15 that is formed with a curve conforming to the shape of the outside of the roll paper 20 is disposed in the bottom of the roll paper compartment 17, and supports the bottom of the roll paper 20 loaded into the roll paper compartment 17. The top of the roll paper compartment 17 is opened and closed by the cover frame 12.

The roll paper 20 is loaded in the roll paper compartment 17 with the core of the roll paper 20 parallel to the width of the main frame 13. Because the roll paper holder 15 is basically arc-shaped, the roll paper 20 remains stably supported on top of the roll paper holder 15 as the diameter of the roll decreases in conjunction with the roll paper 20 being used. The roll paper holder 15 is also preferably plastic, and is further preferably made of plastic with a low coefficient of friction. This reduces friction with the roll paper 20, and enables the roll paper 20 to roll smoothly inside the roll paper compartment 17 so that the roll paper 20 can be pulled smoothly off the roll.

A first platen roller 27 and a second recording head 42 are disposed to the main frame 13 adjacent to the roll paper compartment 17. The first recording head 22 applies pressure to the first platen roller 27 with the roll paper 20 therebetween. The second recording head 42 records images on the front of the roll paper 20.

As shown in FIG. 3 the printer assembly 11 also has an automatic paper cutter 36 with a movable knife 32 disposed downstream from the second recording head 42 for cutting the printed roll paper 20. A stationary knife 33 is positioned on the opposite side of the roll paper 20 transportation path as the automatic paper cutter 36.

The stationary knife 33 is disposed at the top of the distal end part of the cover frame 12, and is fixed in position opposite the automatic paper cutter 36 when the top cover 5 (see FIG. 1) and cover frame 12 are closed. The automatic paper cutter 36 is attached to the front end part of the main frame 13, and houses the movable knife 32 in a box-like case. An opening through which the movable knife 32 can move in and out to the transportation path is provided in this case. A movable knife drive unit including a motor causes the movable knife 32 to protrude from this opening into the transportation path.

When the movable knife drive unit of the automatic paper cutter 36 operates and drives the movable knife 32 toward the stationary knife 33, the movable knife 32 and stationary knife 33 cut the roll paper 20 therebetween with a scissor action.

The stationary knife 33 has a blade shutter 34 that covers the stationary knife 33 and a shutter spring 35 connecting the blade shutter 34 with the cover frame 12. The urging force of the shutter spring 35 urges the blade shutter 34 in the direction covering the stationary knife 33. When the top cover 5 is open, the urging force of the shutter spring 35 causes the blade shutter 34 to move and cover the stationary knife 33. When the top cover 5 is closed, the blade shutter 34 contacts a stop protruding from the main frame 13 and is pushed up against the urging force of the shutter spring 35 so that the stationary knife 33 is exposed. This configuration causes the stationary knife 33 to be covered by the blade shutter 34 when the top cover 5 is open so that foreign objects cannot touch the stationary knife 33. When the top cover 5 is closed the blade shutter 34 is pushed up so that it does not interfere with the cutting action of the movable knife 32 and stationary knife 33. The urging force of the shutter spring 35 is also applied by the blade shutter 34 to the protrusion on the main frame 13 and therefore works to open the top cover 5 when the opening button 7 is depressed.

Figure 4:
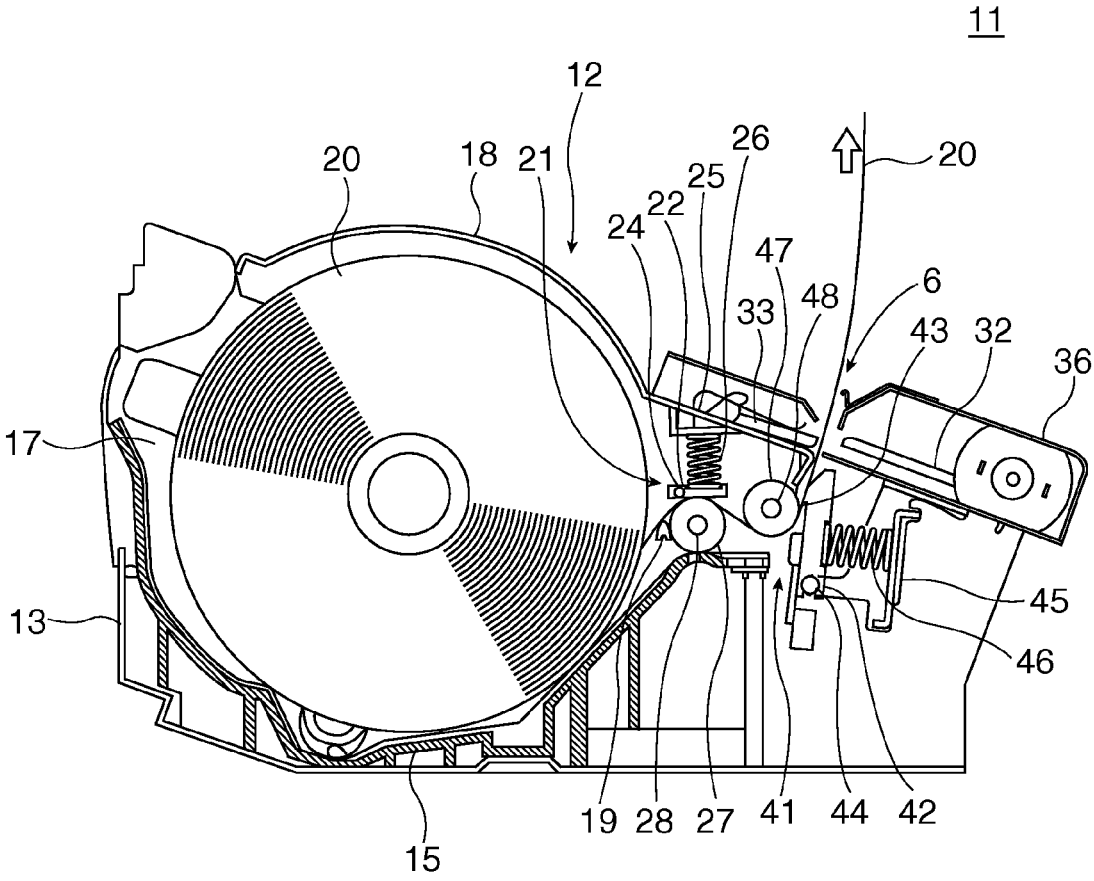
FIG. 4 is a section view showing the internal construction of the thermal printer.
Figure 5:
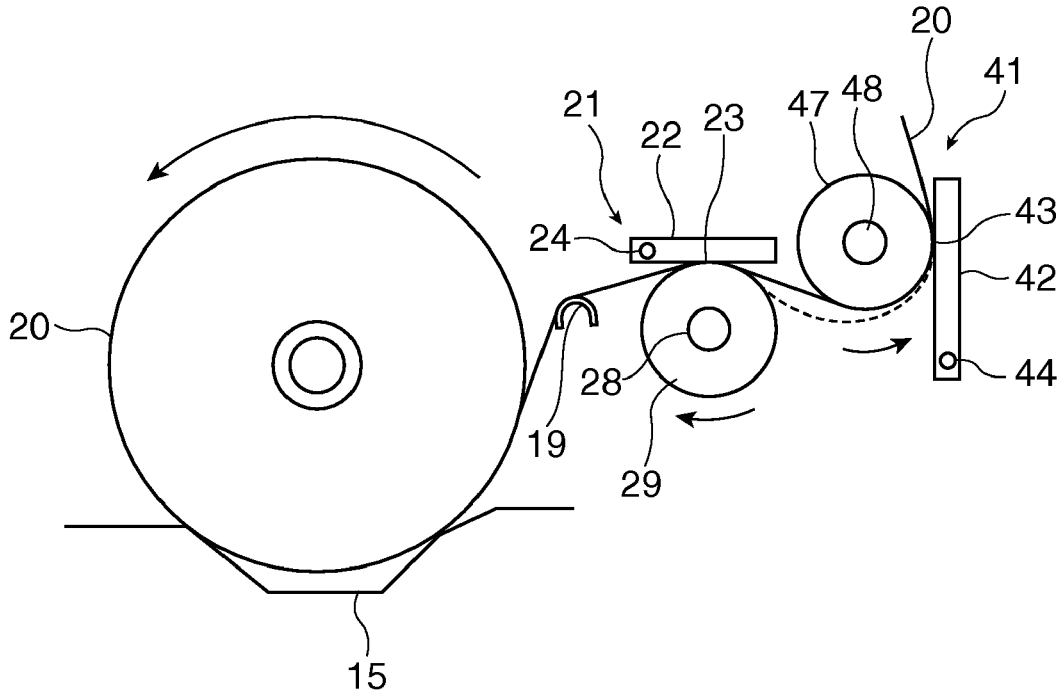
FIG. 5 is an enlarged view of a portion of 4.

FIG. 4 is a section view showing the internal construction of the printer assembly 11 when the cover frame 12 is closed. FIG. 5 is an enlarged view of the main part in FIG. 4, particularly the first recording unit 21, the second recording unit 41, and associated parts.

As described above the printer assembly 11 includes a first recording head 22 for recording images to one side (the back side in this example) of the roll paper 20, and a second recording head 42 for recording images on the other side (the front side in this example). The first recording head 22 is positioned on the upstream side of the roll paper 20 transportation path, and includes a first platen roller 27 and a first recording unit 21. The second recording head 42 is downstream from the first recording head 22, and includes a second platen roller 47 and a second recording unit 41.

The first recording head 22 is supported on the cover frame 12 (FIG. 2), and the first platen roller 27 is supported on the main frame 13.

The second recording head 42 is supported on the main frame 13 side, and the second platen roller 47 is supported on the cover frame 12.

As a result, when the top cover 5 (FIG. 1) and cover frame 12 are opened, the roll paper 20 can be placed into the roll paper compartment 17, and a predetermined length of the roll paper 20 can be pulled out over the first platen roller 27 and second recording head 42 supported on the main frame 13, and positioned over the automatic paper cutter 36. When the cover frame 12 is then closed, the roll paper 20 is held between the first recording head 22 and the first platen roller 27, and between the second recording head 42 and the second platen roller 47. A nipping area is thus formed between the first recording head 22 and first platen roller 27 and between the second recording head 42 and second platen roller 47. The leading end of the roll paper 20 is also threaded between the automatic paper cutter 36 and stationary knife 33 and out from the paper exit 6.

Loading the roll paper 20 is therefore a task of simply opening the top cover 5, inserting the roll paper 20 into the roll paper compartment 17, pulling out a predetermined length of the roll paper 20, and then closing the top cover 5.

The first recording head 22 is a line thermal head that has a first thermal element 23 composed of a plurality of heating elements arrayed in a line, and overall is shaped like a flat plate. The first recording head 22 is supported on a support shaft 24 to rotate freely on the side of the cover frame 12. The first recording head 22 is disposed so that the first thermal element 23 faces the bottom of the main frame 13, and the back of the first recording head 22 is urged by a spring 26 to move away from the cover frame 12 and toward the first platen roller 27.

The spring 26 is a compression spring that increases the gap between the first recording head 22 and a first pressure plate 25 disposed to the cover frame 12. When the cover frame 12 is closed, the urging force of the spring 26 pushes the first recording head 22 to the first platen roller 27 with the roll paper 20 therebetween.

The first platen roller 27 is supported on the sides of the main frame 13 by a shaft 28, which protrudes from both ends of the roller, enabling the first platen roller 27 to rotate freely. The ends of the shaft 28 extend outside of the side walls of the main frame 13, and a first platen gear 29 (FIG. 2) for driving the first platen roller 27 is attached to an exposed end of the shaft 28.

The second recording head 42 is a line thermal head that has a second thermal element 43 composed of a plurality of heating elements arrayed in a line, and overall is shaped like a flat plate. The second recording head 42 is supported on a support shaft 44 to rotate freely on the side of the main frame 13. The second recording head 42 is disposed substantially perpendicularly to the bottom of the main frame 13 so that the second thermal element 43 faces the roll paper compartment 17. A spring 46 that urges the second recording head 42 away from a second pressure plate 45 disposed to the main frame 13 is disposed to the back of the second recording head 42.

When the cover frame 12 is closed, the urging force of the spring 46 pushes the second recording head 42 to the second platen roller 47 with the roll paper 20 therebetween.

The second platen roller 47 is supported on the sides of the cover frame 12 by a shaft 48, which protrudes from both ends of the roller, enabling the second platen roller 47 to rotate freely. The ends of the shaft 48 extend outside of the side walls of the cover frame 12, and a second platen gear 49 (FIG. 6) for driving the second platen roller 47 is attached to an exposed end of the shaft 48.

A channel 16 for receiving the shaft 28 of the first platen roller 27 is formed in the main frame 13. When the cover frame 12 closes and the shaft 28 contacts the channel 16, the cover frame 12 is positioned vertically and the first recording unit 21 and second recording unit 41 are set to predetermined relative positions.

A tension buffering mechanism 19 that urges the roll paper 20 in a predetermined direction is disposed to the roll paper 20 transportation path between the roll paper compartment 17 and the first recording unit 21. A spring causes the tension buffering mechanism 19 to push up, for example, on the roll paper 20 as seen in FIG. 5, thereby adjusting and keeping the tension on the roll paper 20 constant and preventing sagging and slack.

In a thermal printer 1 according to this embodiment of at least one embodiment of the invention the roll paper 20 is thus held at two places, between the first recording head 22 and first platen roller 27 and between the second recording head 42 and second platen roller 47. The first platen roller 27 and second platen roller 47 are respectively driven rotationally in the direction of the arrows in FIG. 5 by the first platen gear 29 and second platen gear 49 described above, and this rotation of the first platen roller 27 and second platen roller 47 conveys the roll paper 20.

The mechanism for conveying the roll paper 20 is described next.

Figure 6:
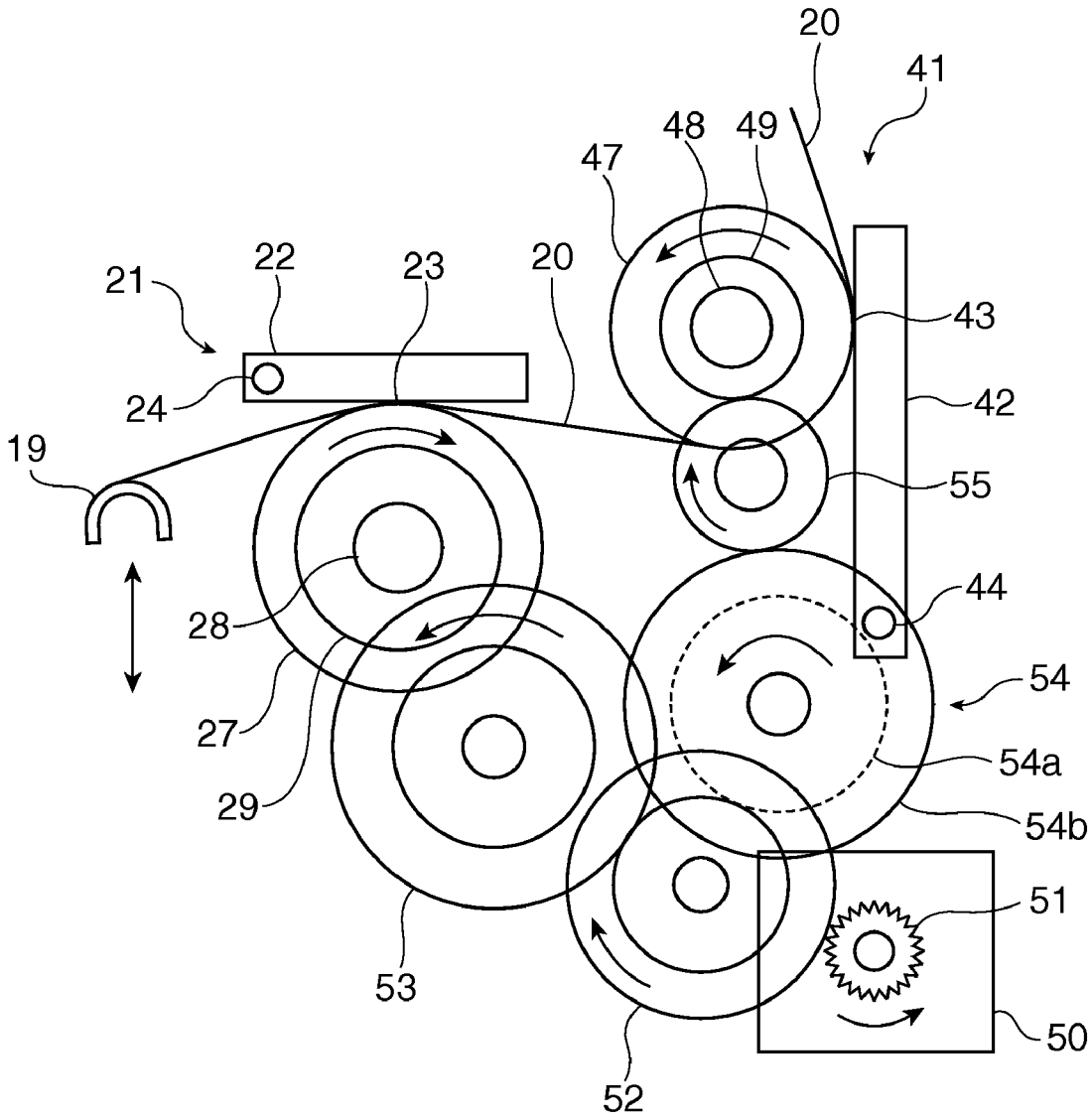
FIG. 6 describes the drive mechanism that drives the first and second platen rollers.

FIG. 6 describes the drive mechanism for driving the first platen roller 27 and second platen roller 47.

As shown in FIG. 6 the thermal printer 1 has a roller drive unit composed of a motor 50, and a motor gear 51, a first gear 52, a second gear 53, and a clutch gear 54 (a drive gear with a torque limiter) for transferring drive power from the motor 50 to the first platen roller 27 and second platen roller 47. This roller drive unit may also include the first platen gear 29 of the first platen roller 27 and the second platen gear 49 of the second platen roller 47. The gears of this roller drive unit are disposed on the outside of the main frame 13, and the motor 50 is inside the main frame 13.

The motor gear 51, first gear 52, second gear 53, and first platen gear 29 of this roller drive unit render a drive train for transferring torque from the motor 50 to the first platen roller 27, and the motor gear 51, first gear 52, clutch gear 54, fourth gear 55, and second platen gear 49 render a drive train for transferring torque from the motor 50 to the second platen roller 47.

The motor gear 51 is a gear that is fixed on the motor shaft of the motor 50, and the first gear 52 is disposed to mesh with the motor gear 51. The first gear 52 meshes with two gears, one being the second gear 53 that meshes with the first platen gear 29 for driving the first platen roller 27, and the other being the clutch gear 54 rendering a clutch mechanism.

The fourth gear 55 that meshes with the second platen gear 49 for driving the second platen roller 47 engages the clutch gear 54.

Each of the gears rotates in the direction indicated by the corresponding arrow in FIG. 6.

More specifically, when the motor 50 operates and the motor gear 51 turns counterclockwise as indicated by the arrow in FIG. 6, the first gear 52 turns clockwise therewith and this rotation of the first gear 52 causes the second gear 53 to turn counterclockwise.

Rotation of the second gear 53 is transferred to the first platen gear 29, causing the first platen roller 27 to turn.

Rotation of the first gear 52 also causes the clutch gear 54 that engages the first gear 52 to turn counterclockwise, and rotation of the clutch gear 54 causes the fourth gear 55 to rotate clockwise. Rotation of the fourth gear 55 is transferred to the second platen gear 49, which causes the second platen roller 47 to turn.

Both the first platen roller 27 and second platen roller 47 are thus driven and rotate as a result of the rotation of a single motor 50.

The first platen roller 27 and second platen roller 47 are made from an elastic, high coefficient of friction material such as a synthetic rubber or silicon plastic, and are respectively pressed against the first recording head 22 and second recording head 42. The roll paper 20 is thus conveyed by the first platen roller 27 and second platen roller 47 without slipping while images are recorded on the roll paper 20 by the first recording head 22 and second recording head 42.

The gear ratios of the motor gear 51, first gear 52, second gear 53, clutch gear 54, fourth gear 55, first platen gear 29, and second platen gear 49 are appropriately adjusted so that the circumferential speed of the first platen roller 27 achieves the desired paper transportation speed and the circumferential speed of the second platen roller 47 is approximately 5% faster than the first platen roller 27. The outside diameters of the first platen roller 27 and second platen roller 47 where the rollers contact the roll paper 20 are the same, and the circumferential speed denotes the speed of the rollers at this outside diameter. The second platen roller 47 on the downstream side therefore conveys the roll paper 20 approximately 5% faster than the transportation speed of the first platen roller 27.

The clutch gear 54 is a gear with a torque limiter unit that uses, for example, the torsion of a coil spring.

More specifically, the clutch gear 54 includes an inside clutch gear 54*a* that engages the first gear 52, an outside clutch gear 54*b* that engages the fourth gear 55, and the coil spring adjusted to provide a predetermined torque load. When the load acting on the clutch gear 54 is less than a set amount, the clutch gear 54 continues turning. When the load exceeds this set amount, the clutch gear 54 slips while holding the constant torque and rotates relatively.

As a result, when the load from the roll paper 20, for example, works in the direction impeding rotation of the second platen roller 47 and this load is greater than the torque setting of the clutch gear 54, the inside clutch gear 54*a* slips while rotating relative to the outside clutch gear 54*b* of the clutch gear 54. More specifically, the inside clutch gear 54*a* rotates in the same direction as the outside clutch gear 54*b* at a faster angular velocity than the outside clutch gear 54*b*, the speed of the second platen roller 47 differs from the normal speed, and the clutch gear 54 transfers constant torque to the second platen roller 47. The torque transferred from the clutch gear 54 to the second platen roller 47 is held constant at this time irrespective of the rotational velocity of the second platen roller 47. As a result, the clutch gear 54 and second platen roller 47 continue turning at the normal rotational velocity even if the roll paper 20 sags, for example, and the load on the second platen roller 47 decreases and drops below the above-noted setting.

As described above, when the motor 50 turns, the roll paper 20 pressed to the outside surfaces of the first platen roller 27 and second platen roller 47 is pulled and conveyed by the first platen roller 27 and second platen roller 47. In conjunction therewith the roll paper 20 inside the roll paper compartment 17 rolls on the roll paper holder 15 and is transported continuously through the transportation path.

The roll paper 20 passes over the tension buffering mechanism 19 and enters the first recording unit 21 at an angle, is heated by the first thermal element 23 held substantially level, and is printed on the back side.

The roll paper 20 then leaves the first recording unit 21 at an angle slightly inverted from the entry angle and enters the second recording unit 41 substantially level. The roll paper 20 then winds around the second platen roller 47 which changes the direction of transportation and directs the paper up, is heated by the substantially vertical second thermal element 43, and is printed on the front side.

If the supplied roll paper 20 sags at either the first recording unit 21 or the second recording unit 41, the relative recording positions on the front and back sides may shift or the roll paper 20 may jam.

However, the tension buffering mechanism 19 in the thermal printer 1 according to this embodiment of at least one embodiment of the invention adjusts and maintains a constant tension on the roll paper 20 between the roll paper compartment 17 and first recording unit 21, and thus prevents the roll paper 20 supplied from the roll paper compartment 17 to the first recording unit 21 from sagging. The tension buffering mechanism 19 can also absorb the momentarily high tension that is applied by the inertia of the wound roll paper 20 when transportation starts and the roll paper 20 is pulled out from the roll paper compartment 17.

Furthermore, because the second platen roller 47 turns approximately 5% faster than the first platen roller 27, the second recording unit 41 pulls the roll paper 20 in faster than the first recording unit 21 discharges the roll paper 20. A force that constantly pulls in the direction of the second platen roller 47 therefore works on the roll paper 20 conveyed between the first recording unit 21 and second recording unit 41, and thus prevents the roll paper 20 from sagging between the first recording unit 21 and second recording unit 41.

In addition, because the second platen roller 47 is driven by a clutch gear 54, the torque applied to the roll paper 20 by the second platen roller 47 is limited at a maximum to the torque set in the clutch gear 54. More specifically, the clutch gear 54 is set to slip at a load produced by the difference between the transportation speeds of the first platen roller 27 and second platen roller 47, and is normally used with the clutch gear 54 constantly slipping. This results in the second platen roller 47 rotating while producing a force that pulls the roll paper 20 with constant force. As a result, the difference in the speeds of the first platen roller 27 and second platen roller 47 is absorbed by the clutch gear 54, and the actual circumferential speeds of the first platen roller 27 and second platen roller 47 are the same.

As a result, the roll paper 20 is held with appropriate tension and is conveyed at a stable constant speed while images are recorded on the front and back sides of the roll paper 20.

A plane passing through the nipping surface of the first recording unit 21 and the plane passing through the nipping surface of the second recording unit 41 are not the same plane and are instead positioned to form a predetermined angle therebetween. More specifically, the angle formed by the plane including the nipping surface of the first recording unit 21 and the plane including the nipping surface of the second recording unit 41 is a predetermined angle. If this predetermined angle is not substantially 0 degrees, that is, the planes are not parallel, the winding angle of the roll paper 20 to the first platen roller 27 and a predetermined winding angle to the second platen roller 47 can be assured. A larger winding angle improves the ability to convey the roll paper 20. This predetermined angle is therefore preferably not 0 degrees.

The nipping surface of the first recording unit 21 as used herein denotes a plane perpendicular to the radius of the first platen roller 27 at the point of contact (nipping part) between the first recording head 22 and first platen roller 27. Likewise, the nipping surface of the second recording unit 41 as used herein denotes a plane perpendicular to the radius of the second platen roller 47 at the point of contact (nipping part) between the second recording head 42 and second platen roller 47.

Because the roll paper 20 is pulled to the first platen roller 27 side in the first recording unit 21, the roll paper 20 winds in the opposite direction along the first platen roller 27 and a large winding angle, that is, the center angle where the roll paper 20 winds around the outside surface of the first platen roller 27, can be assured for the roll paper 20. Slippage between the first platen roller 27 and roll paper 20 is thus inhibited and the roll paper 20 can be reliably conveyed.

In addition, because the direction of the roll paper 20 is changed in the second recording unit 41 as the roll paper 20 winds around the second platen roller 47, a large winding angle is assured. More particularly, because the bottom edge of the second platen roller 47 is positioned below the nipping part of the first recording unit 21, the direction of the roll paper 20 changes from slightly downward to upward as the roll paper 20 winds around the second platen roller 47. As a result, the winding angle at the second platen roller 47 (predetermined winding angle) is 90 degrees or greater than 90 degrees. This inhibits slippage between the second platen roller 47 and the roll paper 20, enables the second platen roller 47 to reliably apply tension to the roll paper 20, and prevents slack and sagging.

The surface recorded by the first recording unit 21 is the surface on the inside of the wound first recording unit 21, and the surface recorded by the second recording unit 41 is the surface on the outside of the roll paper 20. Because the wound roll paper 20 is threaded through the first platen roller 27 and second platen roller 47 and conveyed while curving in alternating directions as shown in FIG. 5, the desired winding angle can be assured at each platen roller.

By thus assuring a sufficient winding angle at the first recording unit 21 and second recording unit 41, a large area of contact can be assured between the roll paper 20 and each platen roller, and torque enabling stable paper transportation can be assured.

This configuration also prevents slipping between the roll paper 20 and second platen roller 47 with minimal distance from the nipping part of the first recording unit 21 and the nipping part of the second recording unit 41. Because the thermal printer 1 cannot print to both sides of the roll paper 20 left between the nipping part of the first recording unit 21 and the nipping part of the second recording unit 41 after image recording is completed, this portion of the roll paper 20 cannot be used effectively and may be thrown away. By shortening the distance from the nipping part of the first recording unit 21 and the nipping part of the second recording unit 41, the amount of the roll paper 20 that cannot be used effectively can be reduced, and the roll paper 20 can be used without waste.

Furthermore, the roll paper 20 can also be easily loaded because the roll paper 20 is threaded through the first recording unit 21 and the second recording unit 41 by simply opening the top cover 5, dropping the roll paper 20 into the roll paper compartment 17, and closing the top cover 5 again.

Sagging is also prevented because the contact area between the roll paper 20 and the first platen roller 27 and second platen roller 47 is large and a clutch enables pulling and conveying the roll paper 20 with constant tension.

The thermal printer 1 according to this embodiment of at least one embodiment of the invention can therefore reliably prevent the roll paper 20 from sagging while images are recorded on the back side of the roll paper 20 by the first recording unit 21 and images are recorded on the front side of the roll paper 20 by the second recording unit 41, the precision of the relative recording positions can be improved, and shifting of the relative recording positions on the front and back sides can be reliably prevented. Paper jams caused by the roll paper 20 sagging can also be prevented. In addition, because slipping between the roll paper 20 and the first platen roller 27 and second platen roller 47 is reduced, wear on the first platen roller 27 and second platen roller 47 is also reduced, and roller durability can be improved.

In addition, sagging that results when a new roll of roll paper 20 is loaded is quickly suppressed when the roll paper 20 is conveyed, and special action to prevent this sagging is not needed.

Because the drive train for transferring the drive power of the motor 50 from the motor gear 51 includes a gear train composed of the first gear 52, second gear 53, and first platen gear 29 and a gear train composed of the clutch gear 54, fourth gear 55, and second platen gear 49, a single motor 50 can be advantageously used to drive both the first platen roller 27 and second platen roller 47. In addition, by appropriately adjusting the gear ratios of the drive gear trains, the speed ratio between the first platen roller 27 and second platen roller 47 can be easily set as desired.

The embodiment described above is only one example of how the invention can be used, and the invention is obviously not limited to the embodiment described above. For example, the clutch gear 54 is described as having a torque limiter unit that uses the torsion of a coil spring in the clutch mechanism, but the invention is not so limited. A clutch mechanism that uses the friction of a circular clutch disk can be used, for example.

Furthermore, the clutch gear 54 is described above as driving the second recording unit 41, but could be disposed on the first recording unit 21. More specifically, the clutch gear 54 can be disposed in the drive gear train that transfers power from the motor 50 to the first platen roller 27 so that the first platen roller 27 rotates with a constant torque applying a constant tension to the roll paper 20.

Yet further, the circumferential speeds of the first platen roller 27 and second platen roller 47 in the foregoing embodiment is controlled by adjusting the gear ratios of the motor gear 51, first gear 52, second gear 53, clutch gear 54, fourth gear 55, first platen gear 29, and second platen gear 49, but the invention is not so limited. For example, the circumferential speed can also be adjusted using the outside diameters of the first platen roller 27 and second platen roller 47, and the detailed construction of other parts of the thermal printer 1 can obviously also be changed as desired.

At least one embodiment of the invention is also described above using by way of example a thermal printer 1 that records images on roll paper 20 that changes color when heated, but the invention is not so limited. For example, the invention can be applied in any recording device that holds and conveys the recording medium between a head and platen roller, including dot impact printers that have a line head. The invention is also not limited to recording devices used as stand-alone devices, and the invention can be applied to other types of recording devices that are incorporated in the same housing as a computing device or are assembled inside other types of devices.

At least one embodiment of the invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A recording device comprising:

a first recording unit that comprises:

a first recording head for recording images on one side of a recording medium, and a first platen roller disposed opposite the first recording head, and conveys the recording medium by rotation of the first platen roller;

a second recording unit that is located on the downstream side in the recording medium transportation direction from the first recording unit, comprising:

a second recording head for recording images on the other side of the recording medium, and a second platen roller disposed opposite the second recording head, and conveys the recording medium by rotation of the second platen roller; and a roller drive unit comprising:

a motor with a motor gear;

an additional gear connected to the motor gear;

at least one first intermediate gear connecting the additional gear to a gear of the first platen roller; and a plurality of second intermediate gears, comprising:

a clutch gear, comprising:

an inside clutch gear that engages the additional gear;

an outside clutch gear; and a coil spring; and a further gear connecting the outside clutch gear to a gear of the second platen roller;

wherein gear ratios of the gears are such that an angular velocity of the second platen roller is higher than an angular velocity of the first platen roller.

2. The recording device described in claim 1, wherein:

the recording medium is wrapped around a predetermined winding angle to at least one of the first platen roller and second platen roller.

3. The recording device described in claim 1, wherein:

a plane including a nipping surface of the first recording head and the first platen roller in the first recording unit, and a plane including a nipping surface of the second recording head and the second platen roller in the second recording unit, are not the same plane and are instead positioned to form a predetermined angle therebetween.

4. The recording device described in claim 1, wherein:

the recording medium is pulled out from a roll past the first recording unit to the second recording unit;

the first recording unit records an image on the surface that is on the inside when the recording medium is in the roll; and the second recording unit records an image on the surface that is on the outside when the recording medium is in the roll.

5. The recording device described in claim 1, wherein:

the recording medium wraps around the second platen roller at an angle of 90 degrees or more.

6. The recording device described in claim 1, further comprising:

a storage unit for storing the recording medium wound in a roll; and a tension buffering mechanism that adjusts the tension of the recording medium on the transportation path from the storage unit to the first recording unit.

7. The recording device described in claim 1, further comprising:

a main frame including a storage unit for storing the recording medium; and a cover frame attached to the main frame to open and close;

wherein the first platen roller and second recording head are disposed on the main frame;

the first recording head and second platen roller are disposed on the cover frame; and nipping parts are formed between the first recording head and first platen roller, and between the second recording head and second platen roller, when the cover frame is closed.

8. The recording device described in claim 1, wherein outer surfaces of the platen rollers that contact the recording medium are substantially the same size as one another.

9. The recording device described in claim 1, wherein the clutch gear comprises a torque limiter.

10. The recording device described in claim 1, wherein the angular velocity of the second platen roller is approximately 5% higher than the angular velocity of the first platen roller.

11. A recording device comprising:

a first recording unit that comprises:

a first recording head for recording images on one side of a recording medium, and a first platen roller disposed opposite the first recording head, and conveys the recording medium by rotation of the first platen roller;

a second recording unit that is located on the downstream side in the recording medium transportation direction from the first recording unit, comprising:

a second recording head for recording images on the other side of the recording medium, and a second platen roller disposed opposite the second recording head, and conveys the recording medium by rotation of the second platen roller; and a roller drive unit comprising:

a motor with a motor gear;

an additional gear connected to the motor gear;

at least one intermediate gear connecting the additional gear to a gear of the first platen roller; and a drive gear train for transferring drive power from the motor gear to the second platen roller, comprising:

a drive gear with a torque limiter that produces slipping when a predetermined load is applied, wherein the drive gear comprises:

an inside clutch gear that engages the additional gear;

an outside clutch gear, and a coil spring; and a further gear connecting the outside clutch gear to a gear of the second platen roller;

wherein gear ratios of the gears are such that an angular velocity of the second platen roller is higher than an angular velocity of the first platen roller.

12. The recording device described in claim 11, wherein outer surfaces of the platen rollers that contact the recording medium are substantially the same size as one another.

13. The recording device described in claim 11, wherein the angular velocity of the second platen roller is approximately 5% higher than the angular velocity of the first platen roller.

* * * * *